US009611734B2

(12) United States Patent
Barfoot

(10) Patent No.: US 9,611,734 B2
(45) Date of Patent: Apr. 4, 2017

(54) CONNECTING FIBER OPTIC CABLES

(71) Applicant: Halliburton Energy Services, Inc., Houston, TX (US)

(72) Inventor: David Andrew Barfoot, Houston, TX (US)

(73) Assignee: Hallitburton Energy Services, Inc., Houston, TX (US)

( * ) Notice: Subject to any disclaimer, the term of this patent is extended or adjusted under 35 U.S.C. 154(b) by 218 days.

(21) Appl. No.: 13/898,832

(22) Filed: May 21, 2013

(65) Prior Publication Data

US 2014/0347192 A1 Nov. 27, 2014

(51) Int. Cl.
*E21B 47/12* (2012.01)

(52) U.S. Cl.
CPC ..... *E21B 47/123* (2013.01)

(58) Field of Classification Search
CPC ..... E21B 47/00; E21B 47/12; E21B 47/121–47/124; G02B 6/3604–6/3816; G01D 5/35303–5/35396
See application file for complete search history.

(56) References Cited

U.S. PATENT DOCUMENTS

| | | | | |
|---|---|---|---|---|
| 5,305,407 | A * | 4/1994 | Monroe et al. | 385/89 |
| 5,373,574 | A | 12/1994 | Marazzi | |
| 5,909,310 | A | 6/1999 | Li et al. | |
| 6,493,133 | B1 | 12/2002 | Liang et al. | |
| 6,685,361 | B1 | 2/2004 | Rubino et al. | |
| 6,821,023 | B2 | 11/2004 | Grob et al. | |
| 7,031,567 | B2 | 4/2006 | Grinderslev et al. | |
| 7,641,395 | B2 | 1/2010 | Ringgenberg et al. | |
| 8,152,384 | B2 | 4/2012 | de Jong et al. | |
| 2003/0094281 | A1* | 5/2003 | Tubel | 166/250.03 |
| 2004/0013040 | A1* | 1/2004 | Maas et al. | 367/140 |
| 2004/0040705 | A1* | 3/2004 | Harkins | 166/250.01 |
| 2004/0081406 | A1* | 4/2004 | Grob et al. | 385/76 |
| 2004/0113104 | A1 | 6/2004 | Maida, Jr. | |
| 2004/0175073 | A1* | 9/2004 | Grinderslev et al. | 385/34 |

(Continued)

FOREIGN PATENT DOCUMENTS

| | | |
|---|---|---|
| GB | 2 397 879 B | 8/2004 |
| JP | 05-034530 | 2/1993 |
| JP | 05-248995 | 9/1993 |

OTHER PUBLICATIONS

Authorized Officer Sung Chul Kang, PCT International Search Report and Written Opinion of the International Searching Authority, PCT/US2014/034832, Aug. 21, 2014, 13 pages.

(Continued)

*Primary Examiner* — Hai Phan
*Assistant Examiner* — Orlando Bousono
(74) *Attorney, Agent, or Firm* — John W. Wustenberg; Parker Justiss, P.C.

(57) ABSTRACT

Mitigating back reflection in fiber optic cables when coupling two fiber optic cables, for example, for implementing in harsh environments including wellbores. As described below, light from a source can travel toward a target through a first fiber optic cable and a second fiber optic cable coupled to the first fiber optic cable using a coupling system. The two fiber optic cables can be coupled such that all or a portion of back reflection at the coupling part is absorbed rather than permitted to travel back toward the source through the first fiber optic cable.

9 Claims, 3 Drawing Sheets

(56) References Cited

U.S. PATENT DOCUMENTS

| | | | | |
|---|---|---|---|---|
| 2005/0263281 | A1* | 12/2005 | Lovell et al. | 166/255.1 |
| 2005/0281511 | A1* | 12/2005 | Ringgenberg et al. | 385/70 |
| 2007/0053629 | A1* | 3/2007 | Meyyappan et al. | 385/15 |
| 2008/0095496 | A1* | 4/2008 | Varadarajan et al. | 385/32 |
| 2008/0210426 | A1* | 9/2008 | Lembcke et al. | 166/302 |
| 2010/0247056 | A1* | 9/2010 | Willsch | 385/137 |
| 2011/0091159 | A1* | 4/2011 | de Jong et al. | 385/72 |
| 2011/0290992 | A1* | 12/2011 | Sato et al. | 250/253 |
| 2011/0311179 | A1* | 12/2011 | Greenaway | 385/12 |
| 2012/0175513 | A1* | 7/2012 | Duncan et al. | 250/269.1 |
| 2012/0181420 | A1* | 7/2012 | Duncan et al. | 250/269.1 |
| 2012/0200422 | A1* | 8/2012 | Duncan et al. | 340/854.7 |
| 2012/0213472 | A1 | 8/2012 | Violante et al. | |
| 2012/0280115 | A1 | 11/2012 | Lo et al. | |
| 2013/0016979 | A1* | 1/2013 | Duncan et al. | 398/139 |
| 2013/0057948 | A1 | 3/2013 | Simonneau et al. | |

OTHER PUBLICATIONS

Seacon, "Optical Underwater Mateable" http://seaconworldwide.com/products/optical-underwater-mateable/, Feb. 19, 2013 (2 pages).

SensorTran, Distributed Temperature Sensing (DTS), Fiber Optic Sensing—DTS Basics, [online] [retrieved on May 20, 2013]. Retrieved from the Internet: <URL: http://www.sensortran.com/technology_dtsbasics.php>. (2 pages).

FiberWatch® Fiber-Optic Distributed Temperature Sensing Service—Halliburton, [online] [retrieved on May 20, 2013]. Retrieved from the Internet: <URL: http://www.halliburton.com/ps/Default.aspx?navid=2474&pageid=4492&prodid=PRN%3 . . . (1 page).

Pinnacle Reservoir Monitoring, Fiber Optic Sensing Technology, "FiberWatch$^{SM}$ Service, Real-Time Fiber Optic Monitoring Solutions" Halliburton, Aug. 2012 (2 pages).

PCT International Preliminary Report on Patentability, PCT/US2014/034832, Dec. 3, 2015, 10 pages.

* cited by examiner

CONNECTING FIBER OPTIC CABLES

TECHNICAL FIELD

This disclosure relates to fiber optic systems used, for example, in wellbores.

BACKGROUND

Fiber optic cables are used to transmit light in fiber-optic communications and optical sensing. For example, in optical sensing, light can represent various signal types, such as temperature, pressure, strain, acceleration, and the like. In some applications, optical sensing can be used in a wellbore by communicating light between a source and downhole sensors or actuators (or both). The fiber optic cables can be embedded in the wellbore's casing, or run down into the wellbore with a well tool (e.g., a logging tool string in a drill pipe string). To cover long distances in a wellbore or in other applications, two or more lengths of fiber optic cables are often joined or coupled using a coupling part. Back reflection can result from, among other things, misalignment of the coupling in the coupling part.

DESCRIPTION OF DRAWINGS

Like reference symbols in the various drawings indicate like elements.

DETAILED DESCRIPTION

Figure 1:
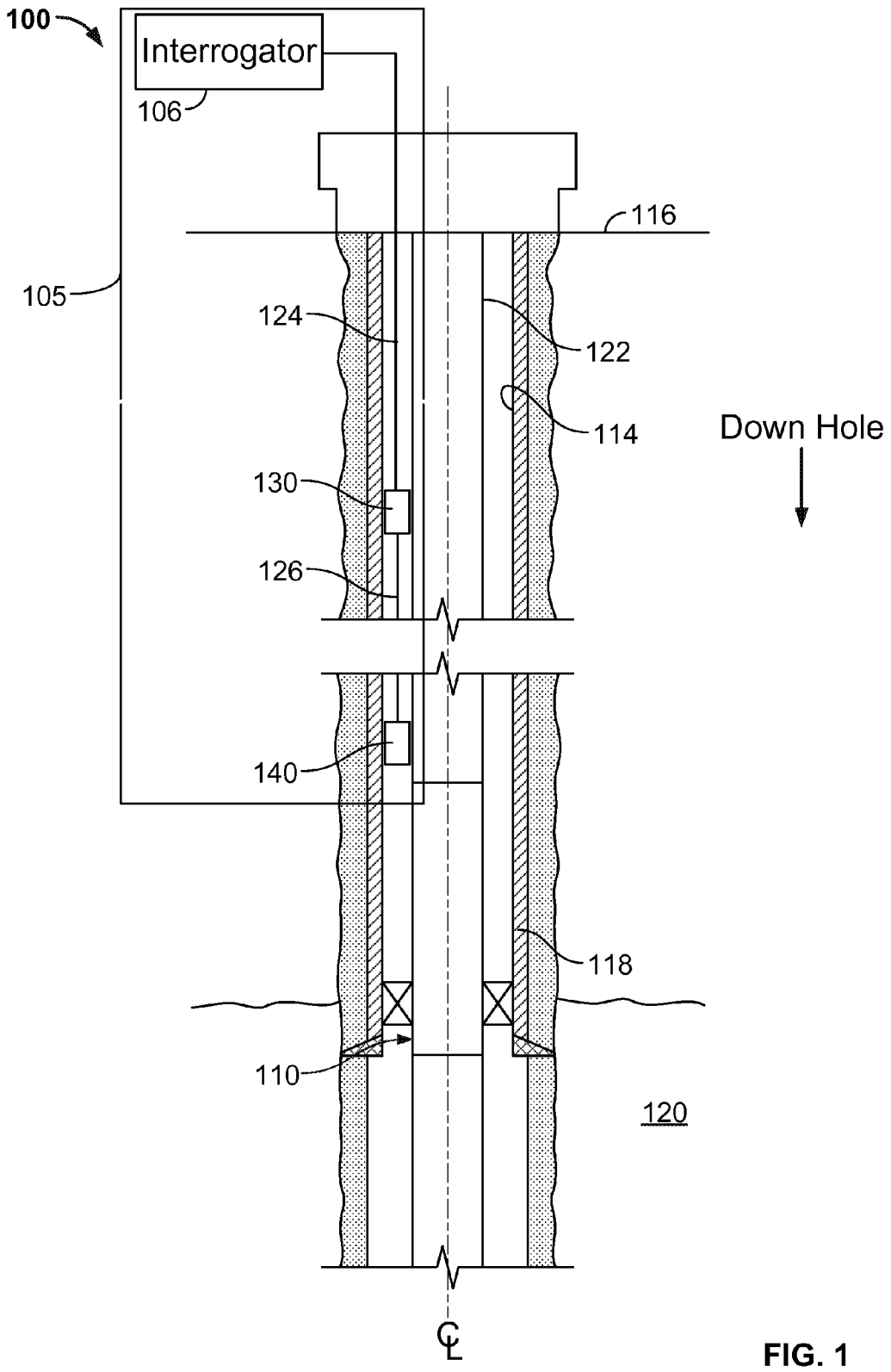
FIG. 1 is a schematic cross-sectional side view of an example well system with fiber optic cable installation.

This disclosure describes blocking back reflection in coupled fiber optic cables. To transmit light through two fiber optic cables, ends of the two cables can be joined or coupled using a coupling, which can include two portions ("coupling parts") that are interfaced together. When light travels from an end of a first fiber optic cable through the coupling into an end of a second fiber optic cable, a portion of the light may be reflected back through the first fiber optic cable. This phenomenon (known, in some examples, as back reflection) may occur, for example, due to a misalignment of the two interfaced coupling parts of the coupling. Alternatively, or in addition, back reflection may occur because an interfacing portion with contaminants has an index of refraction that is different from an index of refraction of the fiber optic cable. Back reflection can undermine the signal carried in the light or damage equipment attached to the fiber optic cables. When fiber optic cables are coupled using one or more couplings in harsh environments such as in wellbores, oil field environment (e.g., at the surface, subsea or downhole or combinations of them), the possibility of misalignment/contamination and the consequent back reflection can be high.

This disclosure describes techniques for blocking back reflection when coupling two fiber optic cables, for example, in harsh environments. As described below, light from a source can travel toward a target through a first fiber optic cable and then through a second fiber optic cable coupled to the first fiber optic cable using a coupling. A light signal is received from the source and communicated to the coupling, for example, through the first fiber optic cable. A portion of the light signal, which is backscattered from the coupling toward the source, can be blocked by the coupling. For example, the coupling can block all of the back scattered light from traveling in the direction of the source through the first fiber optic cable. Alternatively, the coupling can block enough of the back reflected light such that the back reflected light that leaks by (i.e., is not blocked) is less than a specified threshold that does not substantially negatively affect the communication or the components involved in the communication of the light signal. Light signal from the coupling can be communicated to the target, such as an optical sensor or well tool that communicates via a fiber optic cable, for example, through the second fiber optic cable. Light signal, which can include backscattered light signal from the optical sensor or light signal from a downhole source (or both), can be transmitted to the source, for example, through another coupling.

The techniques described here to block back scattered light can mitigate, minimize or eliminate back reflection in two or more fiber optic cables coupled using respective coupling parts. For example, the coupling parts may be misaligned interfacing portions or may include contaminants (or both). Even if a user at the surface coupling two fiber optic cables is not too careful when interfacing the two coupling parts or if the environment in which the two fiber optic cables are coupled is not very clean, the techniques described here can nevertheless block back reflection in the two fiber optic cables. Further, blocking back reflection at the coupling part can allow implementing the coupling part in harsh environments, for example, high temperature wellbore environments, in which an alignment of the interfacing portions of the coupling parts can be difficult to maintain.

The techniques described here can block back reflection occurring due to such differences in indices of refraction between an interfacing portion and a fiber optic cable or between two fiber optic cables. Blocking back reflection can allow increasing the power of light from the light source. Generally, increasing the power of the light may not overcome the effects of back reflection because back reflection also increases with power. But, because back reflection is blocked by implementing the techniques described here, the power of the light can be increased with minimal or no optical sensor signal degradation or interrogator damage. Also, when the back reflection blocking coupling part is de-mated from its opposing end, very limited back reflection will result.

FIG. 1 is a schematic cross-sectional side view of an example well system 100 including an optical communication system 105 in which two fiber optic cables 124 and 126 have been coupled using a fiber optic coupling system 130. Fiber optic cables implemented in systems and environments other than a wellbore can also be coupled using the fiber optic coupling system 130. The well system 100 includes a wellbore 114 that extends from a terranean surface 116 into one or more subterranean zones 120. A tubing string 122 (for example, a production string, an injection string, a drilling string or other suitable type of working string) is inserted into the wellbore 114. The tubing string 122 can carry a well tool 110 with which fiber optic cables can communicate. In some implementations, the wellbore 114 is lined with a casing or liner 118.

In an example configuration, the optical communication system 105 can be installed between the tubing string 122 and the wellbore 114. Alternatively, the optical communication system 105 can be installed within the tubing string 122 or within the casing 118. In some implementations, the optical communication system 105 can be disposed in wireline tools carried on wires (e.g., wirelines, slicklines, or other type of wires). For example, each of the sensors and the fiber optic cables can be included in a wireline tool.

The optical communication system includes two or more fiber optic cables (e.g., a first fiber optic cable 124, a second fiber optic cable 126) to optically communicate light from an interrogator 106 to one or more targets and to optically communicate light from the targets back to the interrogator 106. An optical sensor 140 is an example of a target. Other examples of targets include any downhole source. Examples of fiber optic couplings include E2000, FC/APC, splices between dissimilar fibers, fiber optic rotary joints (FORJ), subsea/down-hole wet-connects or dry-connects, and well-head or subsea tree optical penetrators. In some implementations, the target can be a discrete point sensor or an array of discrete sensors. In some implementations, the target can be a distributed fiber sensor. For example, the continuous length of the fiber optic cable itself can be the sensor.

The interrogator 106 sends light to and receives light from the optical sensor 140. The optical sensor 140 measures one or more physical properties such as temperature, strain, pressure, or other similar physical property. The one or more targets can also be carried on the wires that carry the wellbore tool 110. In implementations in which the continuous length of the fiber optic cable is the sensor, the sensor signal is the backscattered light returned by the fiber in case of Rayleigh, Brillouin, and Raman backscatter. The backscatter signals can be used to measure temperature (Raman), distributed acoustics (Rayleigh), strain (Brillouin) or combinations of them.

In some implementations, the first fiber optic cable 124 and the second fiber optic cable 126 are connected to optically communicate light from the interrogator 106 to the targets through a fiber optic coupling system 130. In general, the fiber optic coupling system 130 is applicable to any manner of two way communication on fiber within the wellbore. As discussed below, the fiber optic coupling system 130 can block back reflection that may occur when coupling parts in the fiber optic coupling system 130 interface the fiber optic cable 124 and the second optic cable 126.

Figure 2:
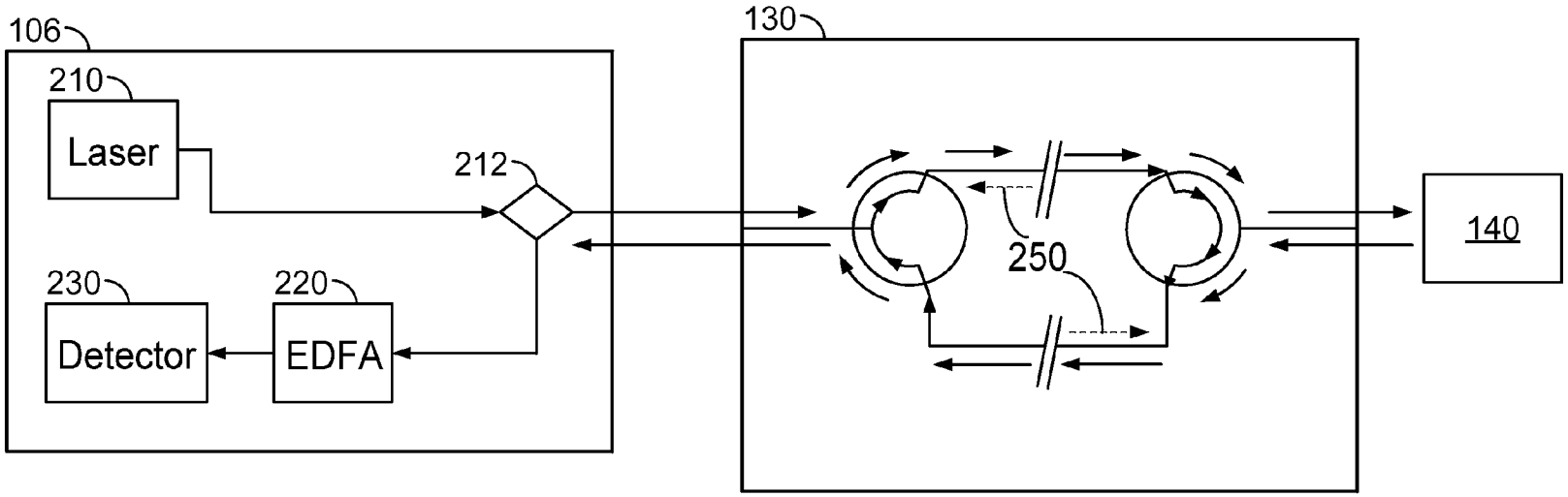
FIG. 2 is a schematic block diagram of an example interrogator communicating with an example optical sensor through an example fiber optic coupling system.
Figure 3:
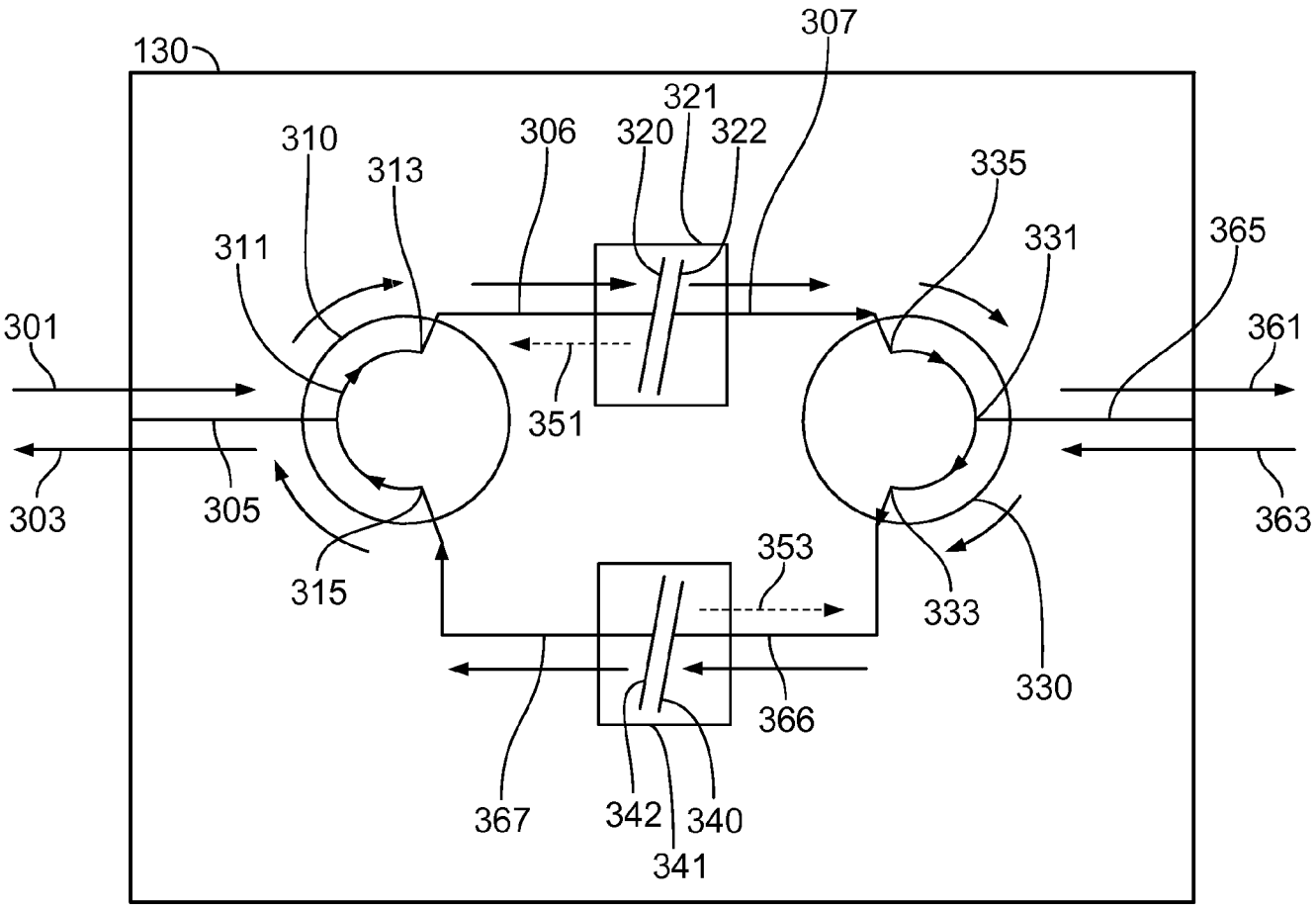
FIG. 3 is a detail operating diagram of the example fiber optic coupling system of FIG. 2.

FIG. 2 is a schematic block diagram 200 of the interrogator 106 communicating with the optical sensor 140 through the fiber optic coupling system 130. Example components of the fiber optic coupling system 130 are illustrated in FIG. 3. The interrogator 106 includes a light source 210, which can produce light transmitted to the optical sensor 140 through a connector 212 and the fiber optic coupling system 130. In some implementations, components of the interrogator 106 can be included in a first housing that is disposed separately from a second housing that includes components of the fiber optic coupling system 130. The two housings can be optically coupled to communicate light from the interrogator 106 to a target (e.g., an optical sensor 140) through the fiber optic coupling system 130 and vice versa.

In an example light signal flow, light travels from the interrogator 106 to the fiber optic coupling system 130 through a source-side fiber optic cable, for example, a first fiber optic cable 305 (FIG. 3). The fiber optic coupling system 130 includes a source-side optical circulator 310 that communicates light to a source-side portion 320 of a source-to-target coupling part 321. In general, an optical circulator is a non-reciprocal optical device used to separate light signals that travel in opposite directions in an optical fiber. The circulator is a device including three ports arranged in a sequence and designed such that light signal entering a port exits from the next port in the sequence. That is, light signal entering a first port in the sequence is emitted from a second port in the sequence. But, if some of the emitted light is reflected back to the circulator, the back reflected light is not emitted out of the first port, but rather out of a third port in the sequence. In this manner, an optical circulator enables bi-directional transmission of light signals over a single optical fiber.

The source-side optical circulator 310 includes a fiber optic input/output 311 (e.g., a bidirectional fiber optic port) that receives an incoming light signal 301 from the interrogator 106. The source-side optical circulator 310 transmits the light received at the fiber optic input/output 311 towards a fiber optic output 313 (e.g., a unidirectional fiber optic port). The fiber optic output 313 transmits the light toward the source-side portion 320 of the source-to-target coupling part 321 through a source-side fiber optic cable 306. The source-side optical circulator 310 is designed to not permit block transmission of light received at the fiber optic output 313 toward the fiber optic input/output 311. Consequently, the source-side optical circulator 310 blocks (e.g., by absorbing) all or most of back reflected light 351 that the source-side optical circulator 310 receives from the source-side portion 320 of the source-to-target coupling part 321 at the fiber optic output 313. The source-side optical circulator 310 need not block all of the back reflected light 351 received at the fiber optic output 313. Instead, as described above, the source-side optical circulator 310 can block a specified threshold of back reflected sufficient for one or more components of the interrogator 106 to not be substantially negatively affected by a quantity of back reflected light that is not blocked by the source-side optical circulator 310. By blocking the back reflected light, the source-side optical circulator 310 mitigates (e.g., minimizes or eliminates) back reflection from the source-side portion 320 of the source-to-target coupling part 321.

The source-to-target coupling part 321 includes a target-side portion 322 that receives the light from the source-side portion 320. The target-side portion 322 of the source-to-target coupling part 321 communicates the received light to a fiber optic input 335 of a target-side optical circulator 330 through a target-side fiber optic cable, for example, a second fiber optic cable 307. The target-side optical circulator 330 can transmit the light received at a second fiber optic input 335 (e.g., a unidirectional fiber optic port) toward a fiber optic input/output 331 (e.g., a bidirectional fiber optic port). The target-side optical circulator 330 transmits the light received at the fiber optic input/output 331 to a target, e.g., the optical sensor 140 (in FIG. 2) as an output signal 361.

The target (e.g., the optical sensor 140) returns a return signal 363 to the target-side optical circulator 330 at the fiber optic input/output 331. The return signal 363 includes communications (e.g., measurement values) generated at the target. For example, when implemented in a wellbore, the return signal 363 can be modulated to transmit the communications uphole to the interrogator 106. The target-side optical circulator 330 transmits the light received at the fiber optic input/output 331 towards a fiber optic output 333 (e.g., a unidirectional fiber optic port), which, in turn, transmits the light toward a target-side portion 340 of a target-to-source coupling part 341 through another target-side fiber optic cable 366.

A portion of the return signal 363 may be backscattered at the target-side portion 340 of the target-to-source coupling part 341 and travel to the fiber optic output 333 as back reflected light 353. Similarly to the source-side optical circulator 310, the target-side optical circulator 330 is also designed to prevent transmission of light received at the fiber optic output 333 toward the fiber optic input/output 331. Consequently, the target-side optical circulator 330 blocks all or most of the back reflected light 353. By doing so, the target-side optical circulator 330 can avoid blinding a receiver (e.g., a high-gain receiver) used to pick up generally weak backscattered signals obtained in implementations in which the continuous length of the fiber is a sensor. The non-reflected portion of the return signal 363 continues to travel through the source-side portion 342 of the target-to-source coupling part 341 and through another source-side fiber optic cable 367 to enter the source-side optical circulator 310 at a fiber optic input 315 (e.g., a unidirectional fiber optic port). The light then exits the source-side optical circulator 310 at the fiber optic input/output 311 as a return signal 303 that travels through the source-side fiber optic cable 305 to the interrogator 106 (as shown in FIG. 2).

The return signal 303 enters the interrogator 106 and reaches the connector 212. The connector 212 transmits the return signal 303 to a detector 230. In some implementations, the interrogator 106 includes an Erbium doped fiber amplifier (EDFA) 220 that receives the return signal 303 from the connector 220, amplifies the returned measurement signal 303, and transmits the amplified return signal to the detector 230. Because back reflected light signals 351 and 353 are blocked by the first and second optical circulators 310 and 330, respectively, the back reflected light signals 351 and 353 do not interfere with the return signal 303 transmitted back to the interrogator 106. Alternatively, a level of interference by the back reflected light signals that are not blocked is insufficient to substantially negatively affect the return signal 303 transmitted back to the interrogator 106.

In some implementations, the source-side portion 320 and the target-side portion 322 of the source-to-target coupling part may include expanded beam connections to allow more light to be guided across the coupling interface of the source-side and target-side portions 320 and 322 in case of misalignment or contamination. For example, the source-to-target coupling part can be implemented at a wellhead that is designed to withstand high pressure. One option to pass fiber optic cables through the wellhead is to include a feed through. Doing so may compromise the ability of the wellhead to withstand high pressures. An alternative option is to implement a transparent material (e.g., glass or ceramic), and to couple the source-side portion 320 and the target-side portion 322 on either side of the transparent material. Doing so can block back reflection through the transparent material disposed in the wellhead.

In some implementations, the second optical circulator 330 may not be needed to block back reflection directed from the source-to-target coupling part 321 toward the interrogator 106. In such situations, the implementation of the target-to-source optical circulator 330 may be to transmit light from the target toward the interrogator 106. Similarly, to block back reflection from the target-to-source coupling part 341 toward the target, the source-to-target fiber optical circulator 310 may not be needed.

A number of implementations have been described. Nevertheless, it will be understood that various modifications may be made without departing from the spirit and scope of the disclosure.

What is claimed is:

1. A fiber optic coupling system comprising:

a first optical circulator comprising:

a first unidirectional fiber optic input port to receive light;

a first bidirectional fiber optic input/output port that is optically coupled to the first unidirectional fiber optic input port to communicate light from the first unidirectional fiber optic input port; and a first unidirectional fiber optic output port that is optically coupled to the first fiber optic input/output port, wherein the first unidirectional fiber optic output port is configured to absorb light reflected back to the first unidirectional fiber optic output port, wherein the first bidirectional fiber optic input/output port is separate from the first unidirectional fiber optic output port;

a first coupling part comprising:

a first portion, the first fiber optic output port to communicate light from the first fiber optic input/output port to the first portion, wherein the first optical circulator absorbs light from the first portion to the first bidirectional fiber optic input/output port; and a second portion optically coupled to the first portion to communicate light from the first portion to the second portion;

a second optical circulator comprising:

a second unidirectional fiber optic input port that is optically coupled to the second portion of the first coupling part to communicate light from the second portion, wherein the second unidirectional fiber optic input port is configured to absorb light reflected back to the second unidirectional fiber optic input port;

a second bidirectional fiber optic input/output port that is optically coupled to the second unidirectional fiber optic input port to communicate light from the second unidirectional fiber optic input port;

a second unidirectional fiber optic output port that is optically coupled to the second bidirectional fiber optic input/output port to communicate light from the second bidirectional fiber optic input/output port to the first unidirectional fiber optic input port of the first optical circulator; and a second coupling part comprising:

a third portion, the second fiber optic output port to communicate light from the second fiber optic input/output port to the third portion, wherein the second optical circulator absorbs light from the second portion to the second bidirectional fiber optic input/output port; and a fourth portion optically coupled to the third portion to communicate light from the third portion to the fourth portion and to communicate light to the first unidirectional fiber optic input port of the first optical circulator.

2. The fiber optic coupling system of claim 1, wherein the first optical circulator prevents a communication of light from the first unidirectional fiber optic output port to the first bidirectional fiber optic input/output port, and wherein the second optical circulator prevents a communication of light from the second unidirectional fiber optic output port to the first bidirectional fiber optic input/output port.

3. The fiber optic coupling system of claim 1, comprising a transparent medium to which the first portion of the first coupling part and the second portion of the second coupling part couple, wherein the transparent medium is configured to block reflection off the transparent medium.

4. The fiber optic coupling system of claim 1, wherein the first unidirectional fiber optic output port is configured to absorb all light reflected back to the first unidirectional fiber optic output port, and wherein the second unidirectional fiber optic output port is configured to absorb all light reflected back to the second unidirectional fiber optic output port.

5. The fiber optic coupling system of claim 3, wherein the transparent medium is configured to absorb all reflection off the transparent medium.

6. The fiber optic coupling system of claim 1, further comprising a first fiber optic cable coupled to the first bidirectional fiber optic input/output port of the first optical circulator, the first fiber optic cable to communicate light to the first unidirectional fiber optic output port and to receive light from the first unidirectional fiber optic input port.

7. The fiber optic coupling system of claim 6, the first fiber optic cable to receive the light from an interrogator to communicate to the first unidirectional fiber optic output port and to communicate light received from the first unidirectional fiber optic input port to the interrogator.

8. The fiber optic coupling system of claim 1, further comprising a second fiber optic cable coupled to the second bidirectional fiber optic input/output port of the second optical circulator, the second fiber optic cable to receive light from the second unidirectional fiber optic input port and to communicate light to the second unidirectional fiber optic output port.

9. The fiber optic coupling system of claim 8, the second fiber optic cable to communicate the light received from the first unidirectional fiber optic input port to a target positioned downhole in a wellbore and to receive the light from the target to communicate to the second unidirectional fiber optic output port.

* * * * *